US006907663B2

(12) United States Patent
Yoon et al.

(10) Patent No.: US 6,907,663 B2
(45) Date of Patent: Jun. 21, 2005

(54) REFRIGERATOR AND METHOD FOR MANUFACTURING HEAT PIPE UNIT OF REFRIGERATOR

(75) Inventors: Kwon-cheol Yoon, Kwangju (KR); Sak-hang Park, Kwangju (KR)

(73) Assignee: Samsung Electronics Co., LTD, Suwon-si (KR)

( * ) Notice: Subject to any disclaimer, the term of this patent is extended or adjusted under 35 U.S.C. 154(b) by 676 days.

(21) Appl. No.: 09/795,119

(22) Filed: Mar. 1, 2001

(65) Prior Publication Data

US 2002/0005270 A1 Jan. 17, 2002

(30) Foreign Application Priority Data

Jul. 13, 2000 (KR) ..... 2000-40266

(51) Int. Cl.[7] ..... B23P 15/26; F28F 3/12

(52) U.S. Cl. ..... 29/890.035; 29/890.03; 99/486; 99/455; 99/470; 99/483; 165/168; 165/169; 165/64; 165/183; 165/171; 165/47; 62/277; 62/276; 62/275

(58) Field of Search ..... 99/455, 470, 483, 99/486; 165/168, 169, 64, 183, 171; 62/277, 276, 275, 440; 65/47; 29/890.03, 890.035

(56) References Cited

U.S. PATENT DOCUMENTS

| | | | | | |
|---|---|---|---|---|---|
| 2,621,903 | A | * | 12/1952 | Cohler | 165/11.1 |
| 3,208,261 | A | * | 9/1965 | Pasternak | 72/335 |
| 3,343,596 | A | * | 9/1967 | Kritzer | 165/67 |
| 4,470,451 | A | | 9/1984 | Alario et al. | |
| 4,909,316 | A | | 3/1990 | Kamei et al. | |
| 5,085,270 | A | | 2/1992 | Counterman et al. | |
| 5,186,022 | A | * | 2/1993 | Kim | 62/515 |
| 5,275,232 | A | | 1/1994 | Adkins et al. | |
| 5,778,973 | A | | 7/1998 | Shin | |
| 6,230,511 | B1 | * | 5/2001 | Lee et al. | 62/277 |
| 6,526,769 | B2 | * | 3/2003 | Kim | 62/199 |
| 6,619,070 | B2 | * | 9/2003 | Shin | 62/440 |
| 2002/0002838 | A1 | * | 1/2002 | Kim | 62/440 |

FOREIGN PATENT DOCUMENTS

| | | | |
|---|---|---|---|
| JP | 0083886 | * | 4/1986 |
| JP | 59204405 | * | 4/1986 |
| JP | 61083887 | * | 4/1986 |
| JP | 402191507 | * | 7/1990 |
| KR | 2000-0010307 | | 6/2000 |

* cited by examiner

*Primary Examiner*—Marc Jimenez
(74) *Attorney, Agent, or Firm*—Robert E. Bushnell, Esq.

(57) ABSTRACT

Disclosed is a refrigerator comprising an outer casing defining an outer appearance thereof, and an inner casing accommodated in the outer casing, forming a storage chamber, further comprising a heat pipe unit having an evaporator pipe disposed to surround at least one portion of the inner casing, forming a refrigerant path, a heater pipe disposed in parallel with the evaporator pipe, and a connection part connecting the evaporator pipe and the heater pipe, enabling a heat transfer therebetween. With this configuration, there is provided a refrigerator enhancing cooling, ripeness and defrost performances and the productivity.

15 Claims, 10 Drawing Sheets

REFRIGERATOR AND METHOD FOR MANUFACTURING HEAT PIPE UNIT OF REFRIGERATOR

CLAIM OF PRIORITY

This application makes reference to, incorporates the same herein, and claims all benefits accruing under 35 U.S.C. §119 from my application entitled *REFRIGERATOR AND MANUFACTURING METHOD OF HEAT PIPE THEREOF* filed with the Korean Industrial Property Office on 13 Jul. 2000 and there duly assigned Ser. No. 2000/40266.

BACKGROUND OF THE INVENTION

1. Field of the Invention

The present invention relates to a refrigerator having an improved heating system of an evaporator and a heater, and a method for manufacturing a heat pipe unit of the refrigerator.

2. Description of the Related Art

Generally, a refrigerator is comprised of a main body formed with a storage chamber accommodating food therein, and a cooling system provided in the main body, cooling the food accommodated within the storage chamber.

For the convenience's sake to describe the present invention, a kimchi refrigerator comprising a cooling system cooling the storage chamber and a heater raising an inner temperature of the storage chamber will be described by way of example.

Referring to FIG. 10 which is a sectional view of a conventional kimchi refrigerator, the conventional kimchi refrigerator 101 is comprised of a main body 103 having an opening on its top and a door 105 opening and closing the opening.

The main body 103 is comprised of an outer casing 110 defining an outer appearance of the refrigerator, and an inner casing 111 of a cylinder shape accommodated within the outer casing 110, forming a storage chamber 121. Foaming material is filled between the outer casing 110 and the inner casing 111.

On the front upper portion of the outer casing 110 is provided a control panel (not shown) allowing a user to control an operation mode of the kimchi refrigerator to a storage mode or a ripeness mode. In the lower portion of the main body 103 is provided a component chamber 113 accommodating therein devices and units to operate the kimchi refrigerator.

Within the component chamber 113 are installed a compressor 123 compressing a refrigerant to a high temperature and high pressure state, and a condenser (not shown) condensing the compressed refrigerant from the compressor 123 to a low temperature and low pressure state, etc. Alternatively, the condenser may be installed in the space to be filled with the foaming material, formed between the outer casing 110 and the inner casing 111.

On an outer wall of the inner casing 111 are installed an evaporator pipe 133 cooling the inside of the storage chamber 121 by means of the refrigerant supplied from the compressor 123, and a heater pipe 135 raising an inner temperature of the storage chamber 121 to ripen the food accommodated in the storage chamber 121, so as to surround an inner wall of the inner casing 111. Inside the heater pipe 135 is accommodated a hot wire 145 generating heat by means of an electric power supplied from a power supply (not shown).

With this configuration, if the storage mode is selected, a low-temperature refrigerant flows into inside of the evaporator pipe 133, and cool air from the refrigerant flowing inside of the evaporator pipe 133 is transmitted to the inner casing 111, thereby cooling the inside of the storage chamber 121. If the ripeness mode is selected, supply of the refrigerant from the evaporator pipe 133 is suspended, and an electric power is supplied to the heater pipe 135, thereby generating heat from the hot wire 145. The heat generated from the hot wire 145 is transmitted to the inner casing 111 surrounded by the heater pipe 135, thereby increasing the inner temperature of the storage chamber 121. While the refrigerator 101 is being in operation under the storage mode, frost may be produced on the evaporator pipe 133. A defrost mode activating the heater pipe 135 to remove the frost from the evaporator pipe 133 is conducted.

In the conventional kimchi refrigerator, the evaporator pipe and the heater pipe have been manufactured separately, and the cooling and heating functions have been conducted independently, and therefore, the evaporator pipe occupies a cooling surface area for itself relative to the inner casing, and the heater pipe also occupies a heating surface area for itself relative to the inner casing. Where the refrigerator is under the storage mode, a cooling function is supplied in proportion to the cooling surface area of the evaporator pipe. Where the refrigerator is under the ripeness mode and the defrost mode, a heating function is only supplied in correspondence with the heater pipe. Therefore, where the refrigerator is under the storage, ripeness or defrost mode, if both the cooling and heating surface areas corresponding to the evaporator pipe and the heater pipe respectively can be used, the cooling, ripening and defrosting functions may be more improved.

In the conventional kimchi refrigerator, the separate manufacturing of the evaporator pipe and the heater pipe leads to lowering the productivity. In addition, working time to install the evaporator pipe and the heater pipe is prolonged. If the evaporator pipe and the heater pipe can be manufactured in a single unit, this will reduce the number of processes for the production thereof and the time for installation thereof, thereby improving the productivity.

SUMMARY OF THE INVENTION

The present invention has been made keeping in mind the above-described shortcomings, and accordingly, an object of the present invention is to provide a refrigerator having improved cooling, ripening and defrosting functions, and improving the productivity, and a method for manufacturing a heat pipe unit for the refrigerator.

This and other objects of the present invention may be achieved by a provision of a refrigerator comprising an outer casing defining an outer appearance thereof, and an inner casing accommodated in the outer casing, forming a storage chamber, the refrigerator further comprising a heat pipe unit having an evaporator pipe disposed to surround at least one portion of the inner casing, forming a refrigerant path, a heater pipe disposed in parallel with the evaporator pipe, and a connection part connecting the evaporator pipe and the heater pipe, enabling a heat transfer therebetween.

The heat pipe unit is comprised of a bent part to correspond to the shape of the inner casing.

The connection part is of a plate shape, being formed between the evaporator pipe and the heater pipe longitudinally relative to the heat pipe unit.

A portion of the connection part corresponding to the bent part is cut off.

The refrigerator further comprises a heat plate disposed between the inner casing and the heat pipe unit, to surround an outer wall of the inner casing.

The evaporator pipe, the heater pipe and the connection part are contacted with the heat plate.

The evaporator pipe, the heater pipe and the connection part are formed in a single unit.

The refrigerator further comprises a hot wire received within the heater pipe.

The heat pipe unit is formed of a roll-bond type having the evaporator pipe and the heater pipe between a pair of metal plates in contact with each other.

According to another aspect of the present invention, this and other objects may be achieved by a provision of a method for manufacturing a heat pipe unit for a refrigerator comprising a main body formed with an outer casing defining an outer appearance thereof and an inner casing accommodated in the outer casing, forming a storage chamber, the method comprising the steps of preparing a raw material with predetermined width and length; forming a heat pipe unit integrally formed with an evaporator pipe forming a refrigerant path, a heater pipe in parallel with the evaporator pipe, and a connection part connecting the evaporator pipe and the heater pipe so as to enable the heat transfer therebetween, by processing the raw material; and disposing the heat pipe unit to surround the inner casing.

The heat pipe unit has a bent part to correspond in shape to the inner casing.

The connection part takes a plate shape and is connected to the evaporator pipe and the heater pipe longitudinally relative to the heat pipe unit.

The method further comprises the steps of determining a position to be bent, according to a longitudinal direction of the heat pipe unit; cutting off a portion of the connection part corresponding to the bent position; and bending the heat pipe unit zigzag.

The method further comprises the step of accommodating a hot wire within the heater pipe.

The method further comprises the step of bending the bent heat pipe unit to enclose an outer wall of the inner casing.

The method further comprises the step of providing a heat plate between the inner casing and the heat pipe unit, to enclose the outer wall of the inner casing.

The method further comprises the step of mounting the heat pipe unit on the heat plate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
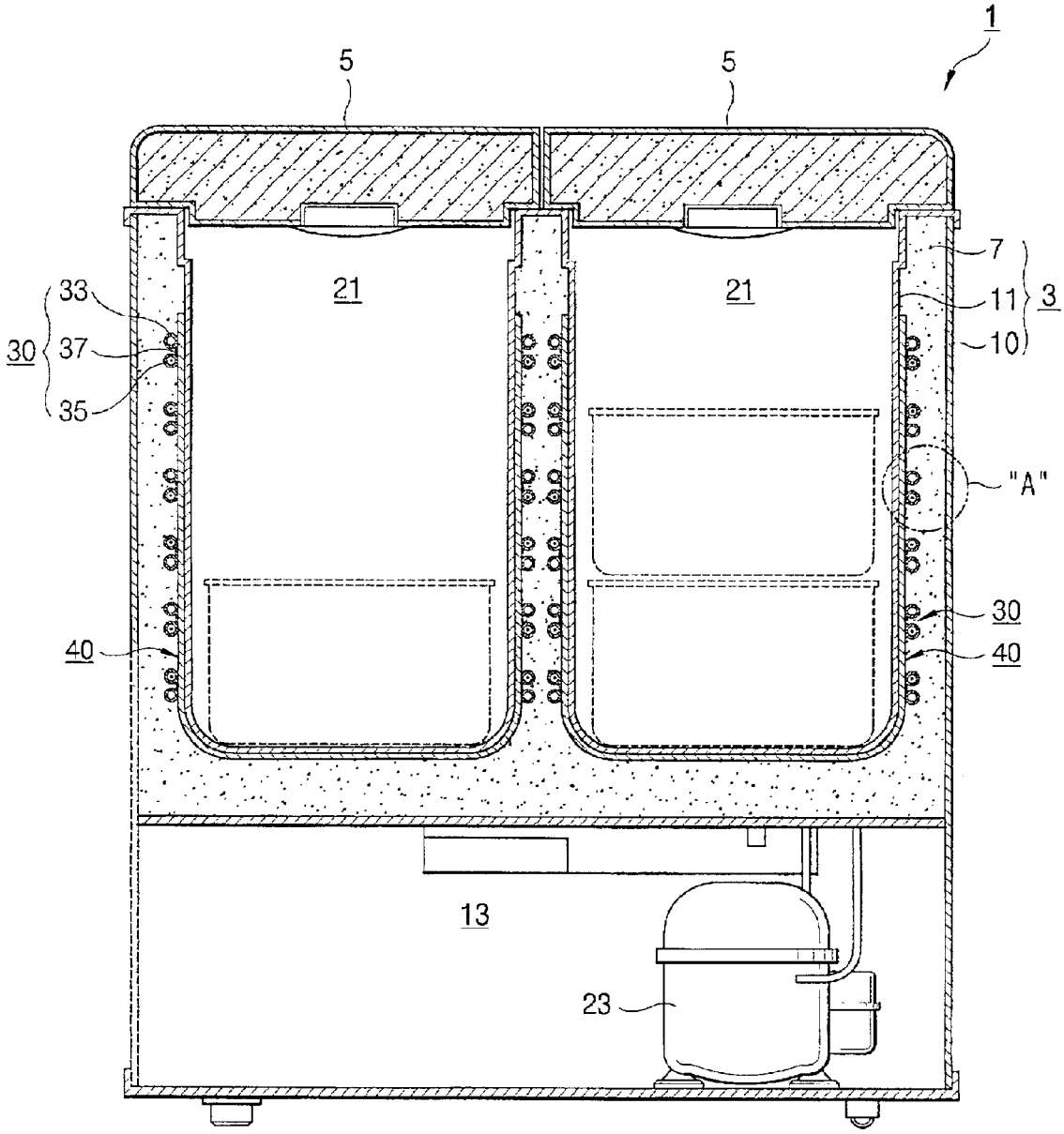
FIG. 1 is a sectional view of a kimchi refrigerator having a heat pipe unit according to the present invention.
Figure 2:
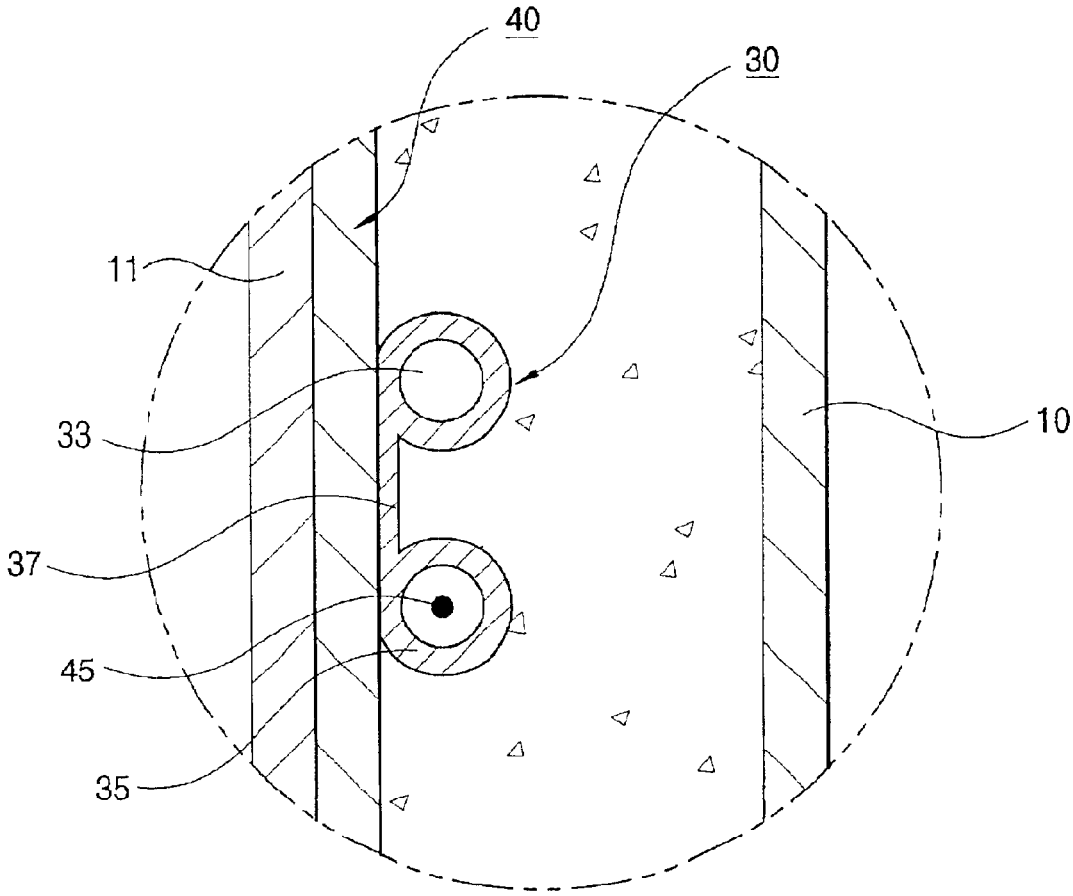
FIG. 2 is an enlarged sectional view of "A" of FIG. 1.

Referring to FIGS. 1 and 2, a kimchi refrigerator 1 according to the present invention is comprised of a main body 3 formed with an opening through which food is put in and taken out, and a door 5 opening and closing the opening of the main body 3.

The main body 3 is comprised of an outer casing 10 defining an outer appearance of the refrigerator 1, and an inner casing 11 of a cylinder shape accommodated within the outer casing 10, forming a storage chamber 21. A foaming material 7 is filled between the outer casing 10 and the inner casing 11. On a front top face of the outer casing 10 is formed a control panel (not shown) controlling an operation of the kimchi refrigerator 1 according to the kind of the food accommodated within the storage chamber. In the lower portion of the main body 3 is installed a component chamber 13 accommodating therein devices and units to operate the kimchi refrigerator 1.

Within the component chamber 13 are installed a compressor 23 compressing a refrigerant to a high temperature and high pressure state, and a condenser (not shown) condensing the compressed refrigerant from the compressor 123 to a low temperature and low pressure state, etc. Alternatively, the condenser may be installed in the space to be filled with the foaming material, formed between the outer casing 10 and the inner casing 11.

In the space filled with the foaming material 7 between the outer casing 10 and the inner casing 11 is installed a heat pipe unit 30 cooling and heating an inner temperature of the storage chamber 21 according to a mode selected from the control panel. Between the inner casing 11 and the heat pipe unit 30 is disposed a metallic heat plate 40 surrounding the inner casing 11.

Figure 3:
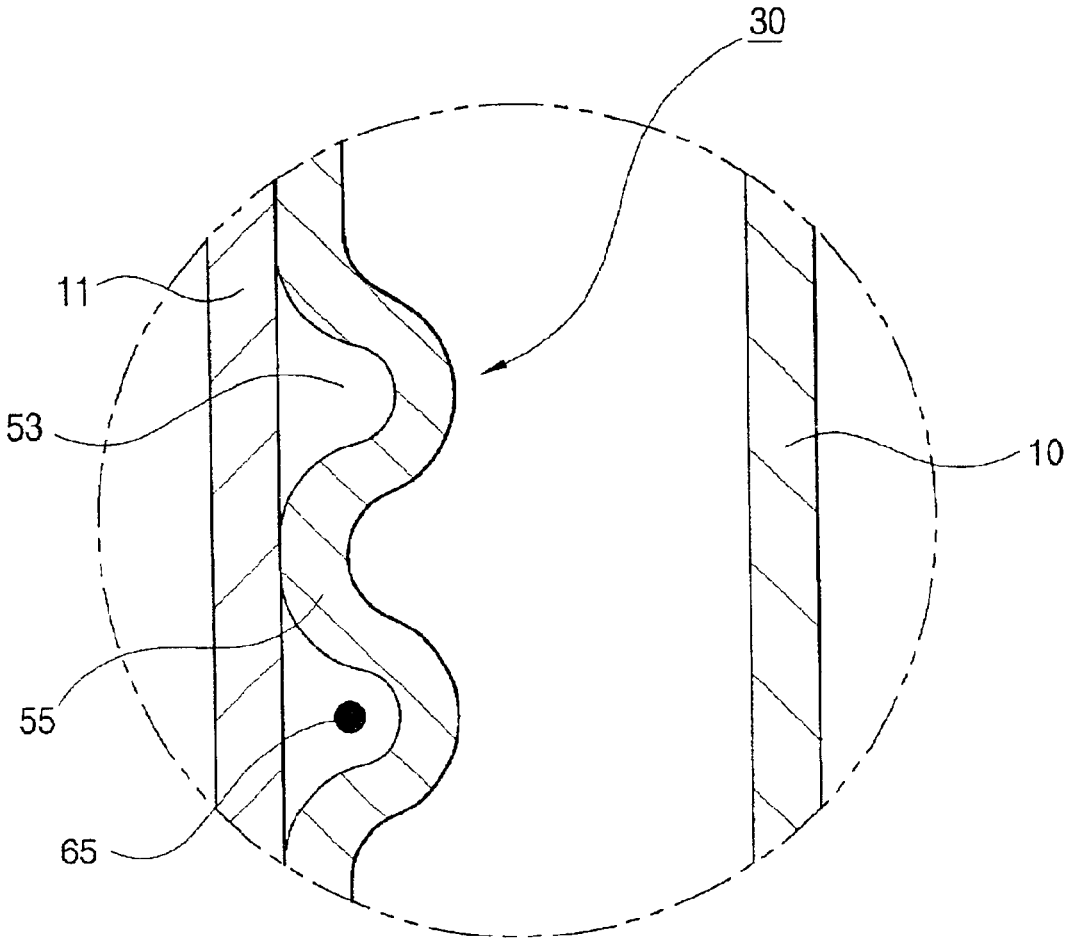
FIG. 3 is a partial sectional view of the heat pipe unit according to another embodiment of the present invention.

As shown in FIG. 3, the heat pipe unit 30 may be manufactured as a roll-bond type comprising an evaporator pipe 53 forming a refrigerant path between a pair of metal plates contacted with each other, and a heater pipe 55 accommodating a hot wire 65 therein.

An inlet of the evaporator pipe 33 is connected to a refrigerant pipe (not shown) extended from a capillary tube (not shown), and an outlet of the evaporator pipe 33 is connected to a refrigerant pipe extended toward the compressor 23. Inside of the heater pipe 35 is accommodated a hot wire 45 electrically connected to a power supply (not shown). The connection part 37 of a plate shape, whose ends are connected to the evaporator pipe 33 and the heater pipe 35 in a single unit, is formed longitudinally relative to the heat pipe unit 30.

The heat pipe unit 30 is constructed such that one sides of the evaporator pipe 33, the heater pipe 35 and the connection part 37 contact the heat plate 40, to thereby increase the efficiency of a heat transfer. The heat pipe unit 30 is comprised of a bent part "B" which is bent to correspond to the shape of the inner casing 11. The connection part 37 corresponding to the bent part "B" is cut off to facilitate its bending.

As shown in FIG. 3, the heat pipe unit 30 may be manufactured as a roll-bond type comprising an evaporator pipe 53 forming a refrigerant path between a pair of metal plates contacted with each other, and a heater pipe 55 accommodating a hot wire 65 therein.

With this configuration, while the refrigerator is in the storage mode, if the low-temperature refrigerant flows into inside of the evaporator pipe 33, the cool air from the refrigerant flowing along the evaporator pipe 33 is transmitted to the heater pipe 35 through the connection part 37. Subsequently, the cool air is transmitted to the whole area of the heat pipe unit 30 through the evaporator pipe 33, the heater pipe 35 and the connection part 37, and the transferred cool air is transmitted to the inner casing 11 through the heat plate 40, to thereby cool the storage chamber 21. Accordingly, the heating surface area of the cool air from the refrigerant flowing along the evaporator pipe 33 is increased, thereby increasing an efficiency of cooling.

If a ripeness mode is selected, supply of the refrigerant to the evaporator pipe 33 is suspended, and an electric power is supplied to the hot wire 45 received in the heater pipe 35, to generate heat from the heater pipe 35. The generated heat is transmitted to the evaporator pipe 33 through the connection part 37, to thereby heat the whole area of the heat pipe unit 30. This heat is transmitted into the inner casing 11 through the heat plate 40, to increase an inner temperature of the storage chamber 21. Accordingly, the heating surface area for the heat from the heater pipe 35 is increased, thereby increasing an efficiency of ripening.

A defrost mode may be operated to remove frost generated on the evaporator pipe 33 before the ripeness mode is selected. While the refrigerator is in the defrost mode, the heat generated from the heater pipe 35 is transmitted to the evaporator pipe 33 directly from the connection part 37, so that the frost on the evaporator pipe 33 is quickly removed, thereby improving an efficiency of the defrosting.

Figure 4:
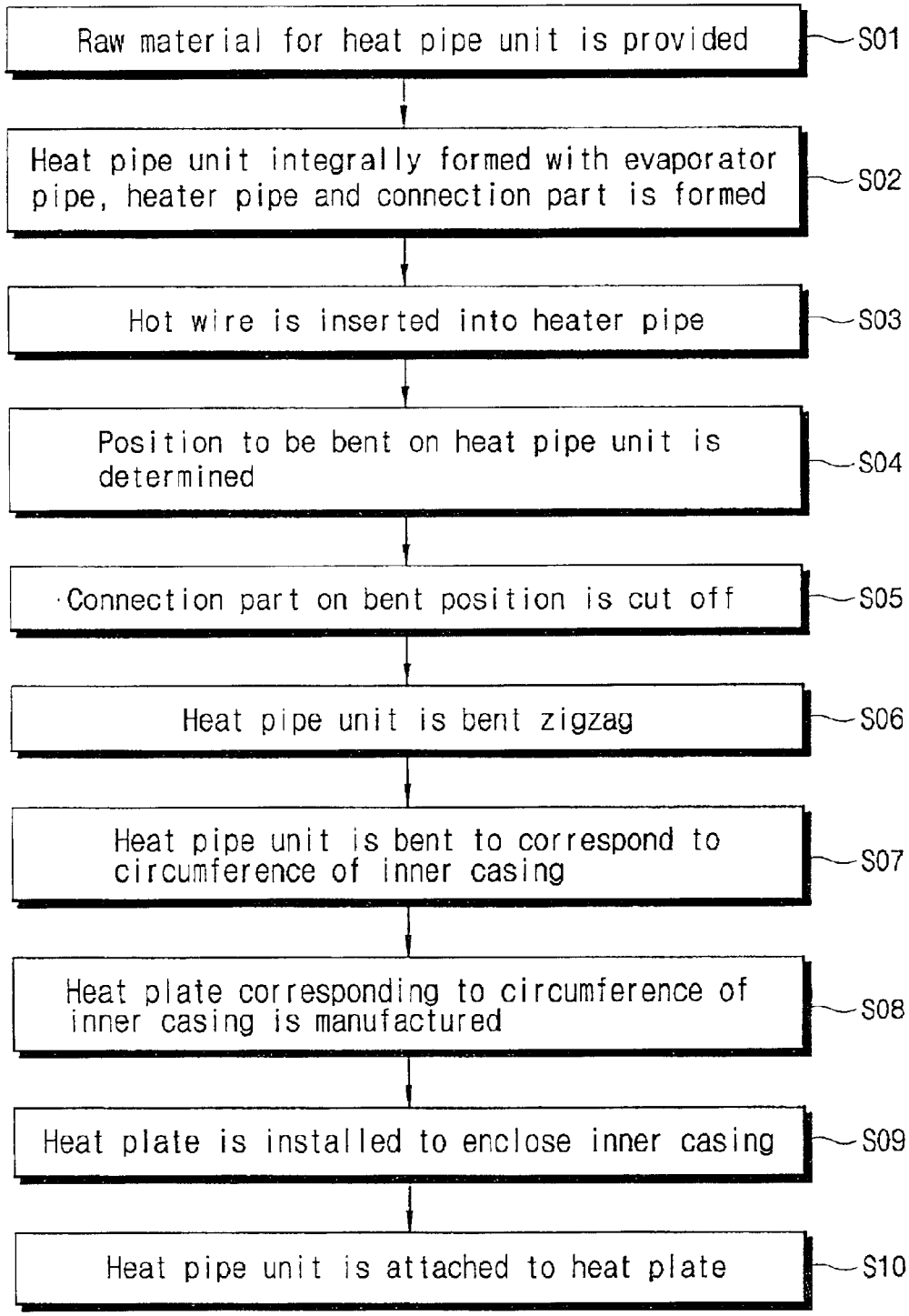
FIG. 4 is a flow chart of a method for producing the heat pipe unit of FIG. 1.
Figure 5:
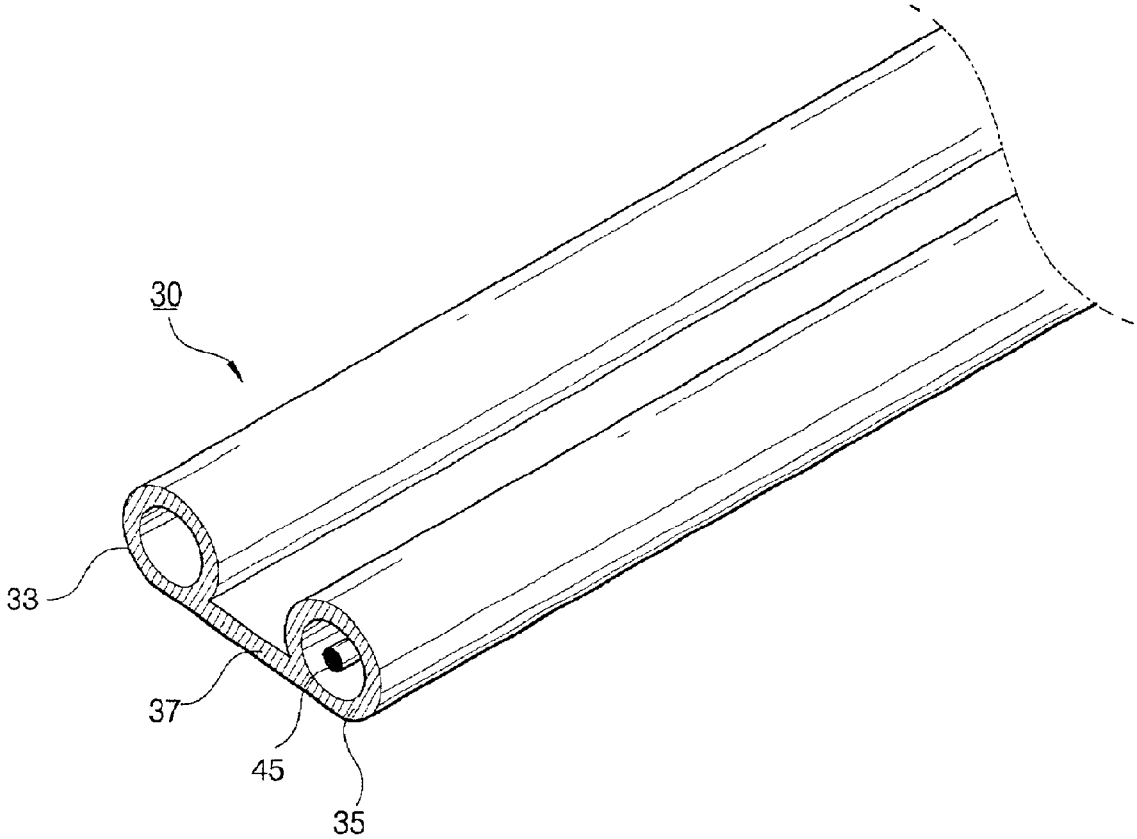
FIGS. 5 through 9 are schematic views briefly showing processes of manufacturing the heat pipe unit of FIG. 4.

A method for manufacturing the heat pipe unit of the refrigerator of FIG. 1 will be described with reference to FIGS. 4 and 5.

First, a raw material for the heat pipe unit with predetermined length and width is provided (S01). By injection molding or drawing molding of the raw material, the heat pipe unit 30 is formed integrally with the evaporator pipe 33, the heater pipe 35 and a connection part 37, as shown in FIG. 5 (S02). The connection part 37 of a plate shape is structured between the evaporator pipe 33 and the heater pipe 35 longitudinally relative to the heat pipe unit 31.

Figure 6:
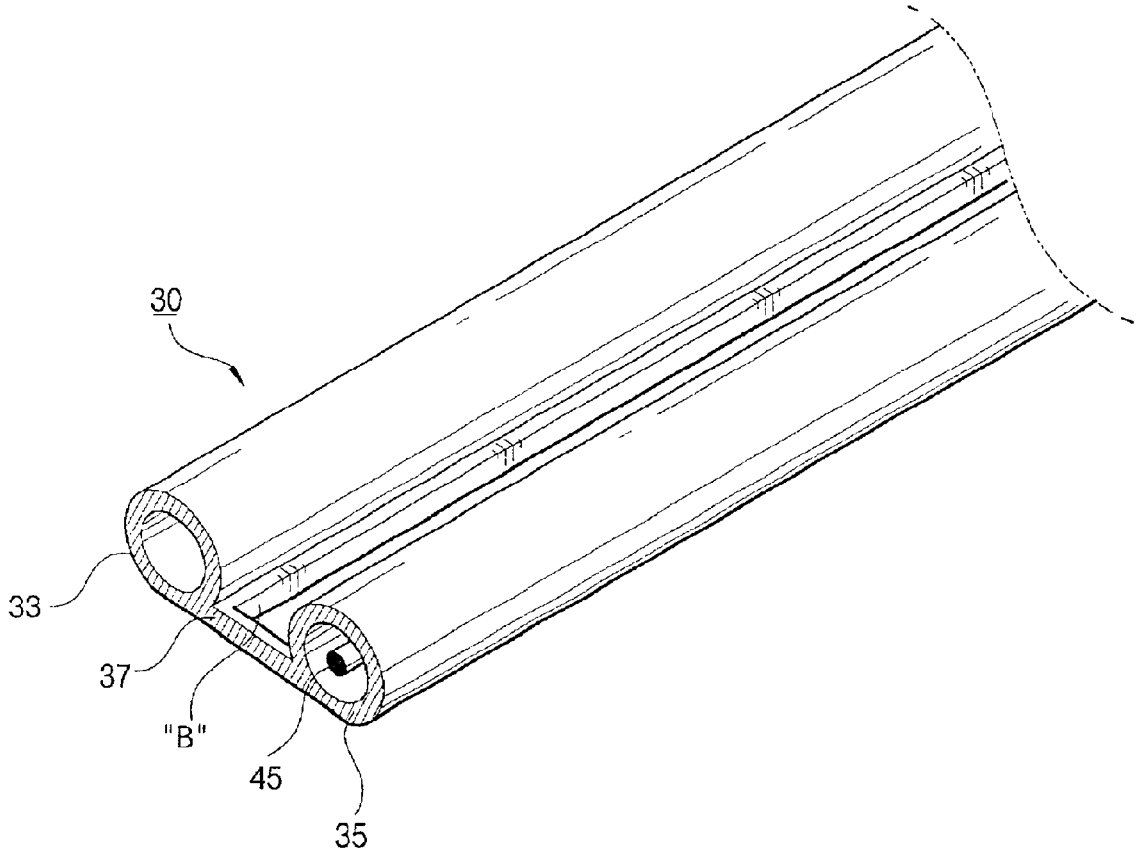
Figure 7:
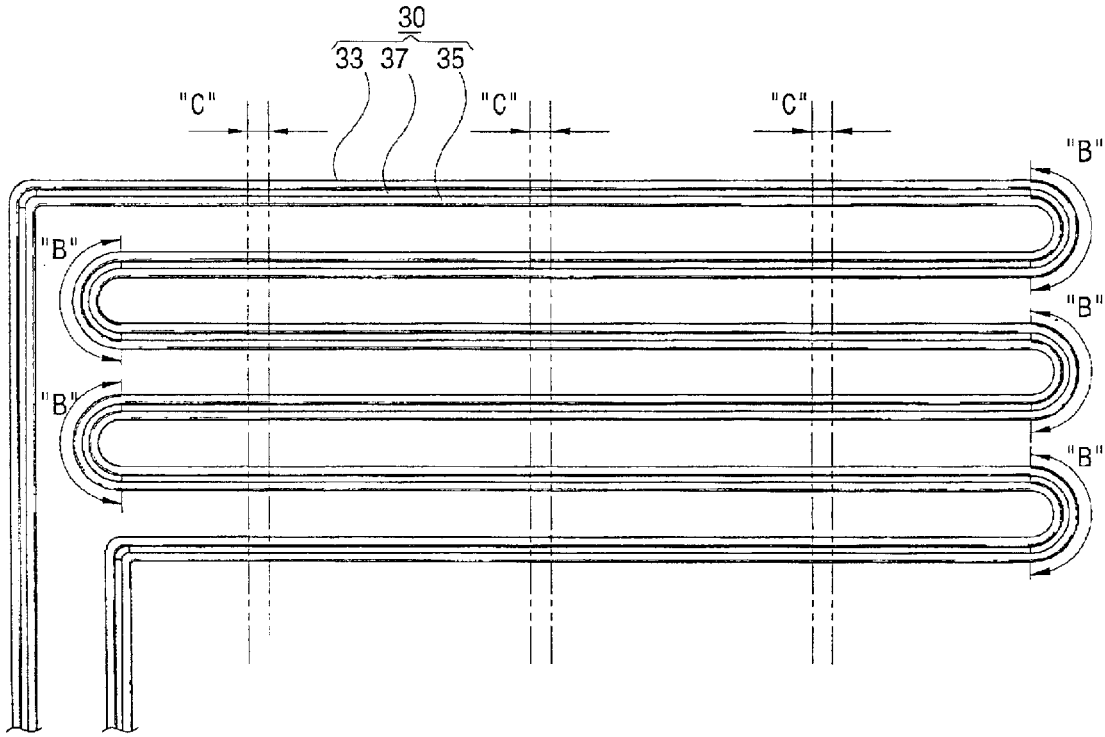
Figure 8:
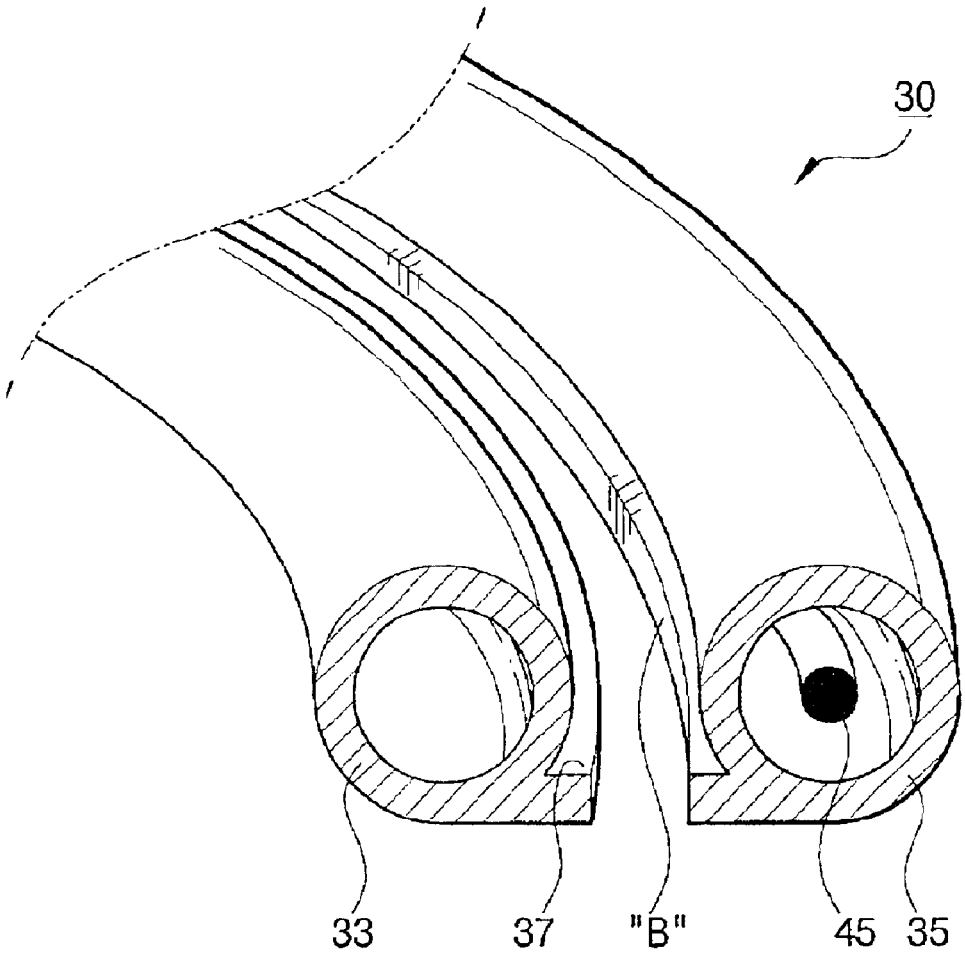
Figure 9:
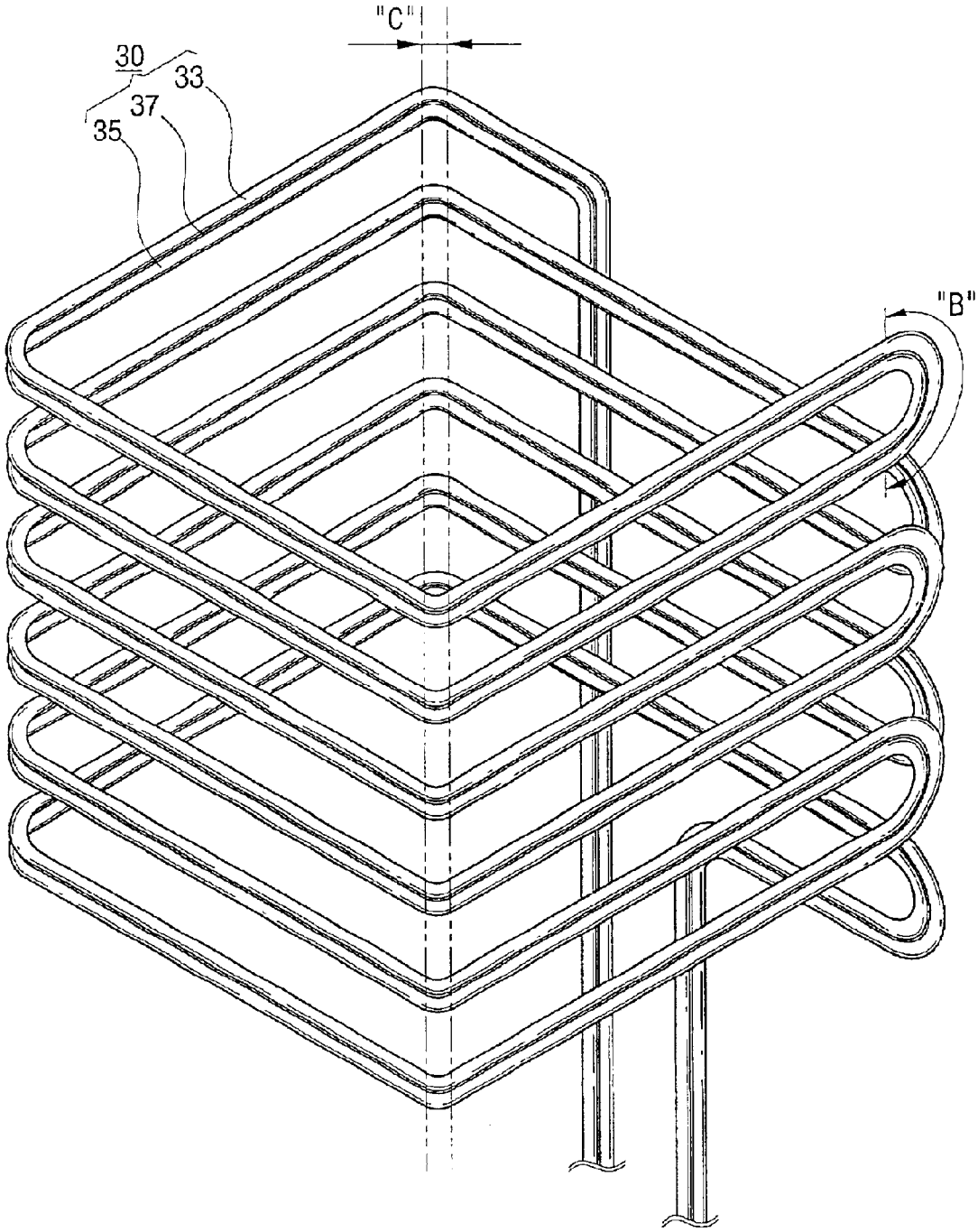
Figure 10:
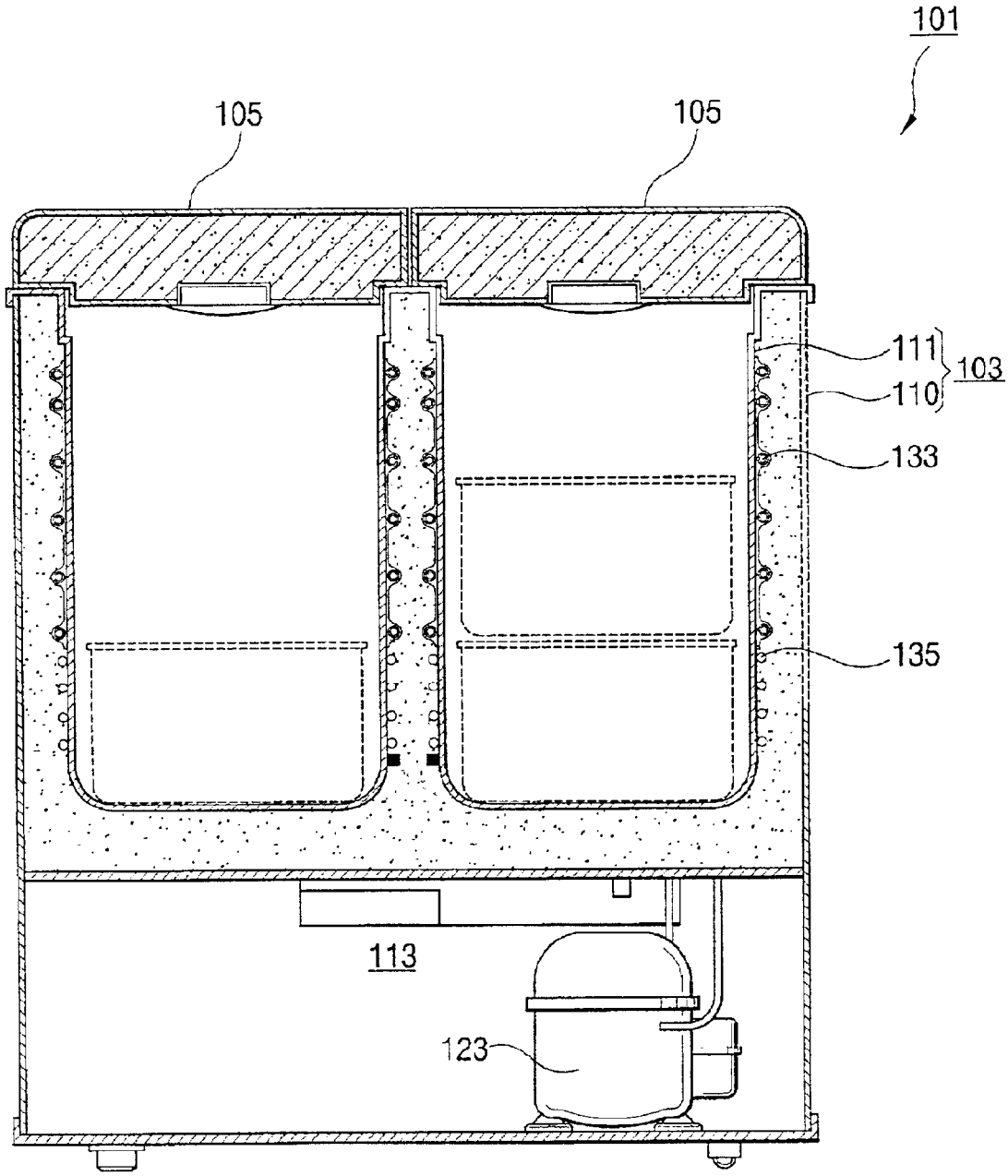
FIG. 10 (PRIOR ART)
FIG. 10 is a sectional view of a conventional kimchi refrigerator.

Once the heat pipe unit 30 is formed, the hot wire 45 is then inserted into the heater pipe 35 (S03). Thereafter, the bent part "B" of the heat pipe unit 30 is determined to correspond to the shape of the inner casing 11 of the kimchi refrigerator 1 (S04). If the bent part "B" is determined, the connection part 37 for the bent part "B" is cut off as seen in FIG. 6 (S05). If the connection part 37 for the bent part "B" is cut off, the heat pipe unit 30 is bent zigzag from the planar shape, as shown in FIGS. 7 and 8 (S06). As shown in FIG. 9, the portion of "C" is bent to correspond to the circumference of the inner casing 11 of the kimchi refrigerator 1, to thereby finish manufacturing the heat pipe unit 30 (S07).

Prior to installing the heat pipe unit 30 at the inner casing 10, the metallic heat plate 40 is manufactured (S08). The manufactured heat plate 40 is installed to surround an outer wall of the inner casing 11 (S09), and thereafter, the heat pipe unit 30 is attached to the outer surface of the heat plate 40 (S10).

By producing a heat pipe unit integrally formed with the evaporator pipe forming the refrigerant path, the heater pipe generating heat, and the connection part connecting the evaporator pipe and the heater pipe so as to enable the heat transfer therebetween, the processes of producing and installing those devices and units having functions of cooling and heating are simplified, thereby increasing the productivity.

As described above, according to the present invention, there are provided a refrigerator enhancing cooling, ripeness and defrost performances and the productivity, and a method for manufacturing a heat pipe unit for the refrigerator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacturing a heat pipe unit for a kimchi refrigerator comprising a main body formed with an outer casing defining an outer appearance thereof and an inner casing accommodated in the outer casing, forming a storage chamber, comprising the steps of:

preparing a raw material with predetermined width and length;

forming a heat pipe unit integrally formed with an evaporator pipe forming a refrigerant path, a heater pipe in parallel with the evaporator pipe, and a connection part connecting the evaporator pipe and the heater pipe so as to enable the heat transfer therebetween, by processing the raw material, said evaporator pipe and said heater pipe being formed such that at least a surface portion of each said evaporator pipe and said heater pipe will contact an outer wall of said inner casing; and disposing the heat pipe unit to surround the inner casing.

2. The method according to claim 1, wherein the heat pipe unit has a bent part to correspond in shape to the inner casing.

3. The method according to claim 2, wherein the connection part takes a plate shape and is connected to the evaporator pipe and the heater pipe longitudinally relative to the heat pipe unit.

4. The method according to claim 2, further comprising the steps of:

determining a position to be bent, according to a longitudinal direction of the heat pipe unit;

cutting off a portion of the connection part corresponding to the bent position; and bending the heat pipe unit zigzag.

5. The method according to claim 2, further comprising the step of accommodating a hot wire within the heater pipe.

6. The method according to claim 5, further comprising the step of bending the bent heat pipe unit to enclose the outer wall of the inner casing.

7. The method according to claim 2, the step of forming the heat pipe unit comprises an injection molding process.

8. The method according to claim 2, the step forming the heat pipe unit comprises an drawing process.

9. A method for manufacturing a heat pipe unit for a kimchi refrigerator comprising a main body formed with an outer casing defining an outer appearance thereof and an inner casing accommodated in the outer casing and a heat plate surrounding an outer surface of the inner casing, forming a storage chamber, comprising the steps of:

preparing a raw material with predetermined width and length;

forming a heat pipe unit integrally formed with an evaporator pipe forming a refrigerant path, a heater pipe connected in parallel with the evaporator pipe to enable the heat transfer therebetween, by processing the raw material, said evaporator pipe and said heater pipe being formed such that at least a surface portion of each said evaporator pipe and said heater pipe will contact an outer wall of said heat plate;

inserting an electrically powered hot wire into said heater pipe; and disposing the heat pipe unit to surround said heat plate surrounding said inner casing.

10. The method according to claim 9, further comprising the steps of:

determining a position to be bent, according to a longitudinal direction of the heat pipe unit;

placing a connection part to couple the evaporator pipe and the heater pipe;

cutting off a portion of the connection part corresponding to the bent position; and bending the heat pipe unit zigzag.

11. The method according to claim 9, the step of forming the heat pipe unit comprises an injection molding process.

12. The method according to claim 9, the step forming the heat pipe unit comprises an drawing process.

13. A heat pipe unit for a kimchi refrigerator comprising a main body formed with an outer casing defining an outer appearance thereof and an inner casing accommodated in the outer casing and a heat plate surrounding an outer surface of the inner casing, forming a storage chamber, the heat pipe unit comprising:

an evaporator pipe, a heater pipe and a connection member integrally formed such that said evaporator pipe is parallel to said heater pipe;

said evaporator pipe forming a refrigerant path;

said connection part connecting the evaporator pipe and the heater pipe so as to enable the heat transfer therebetween,;

an electrically powered hot wire inserted into said heater pipe; and a surface portion of each said evaporator pipe and said heater pipe contacting an outer wall of said heat plate.

14. The heat pipe unit as set forth in claim 13, wherein said evaporator pipe, said heater pipe and said connection member are integrally formed from a raw material during an injection molding process to form said heat pipe unit.

15. The heat pipe unit as set forth in claim 13, wherein said evaporator pipe, said heater pipe and said connection member are integrally formed from a raw material during an a drawing process to form said heat pipe unit.

* * * * *